US005238183A

United States Patent [19]

Sauerwine

[11] Patent Number: 5,238,183

[45] Date of Patent: Aug. 24, 1993

[54] BIFOLD MAILER WITH RETURN ENVELOPE

[75] Inventor: Dean N. Sauerwine, Zionsville, Pa.

[73] Assignee: Moore Business Forms, Inc., Grand Island, N.Y.

[21] Appl. No.: 960,884

[22] Filed: Oct. 14, 1992

[51] Int. Cl.[5] ..... B65D 27/06

[52] U.S. Cl. ..... 229/304; 229/306

[58] Field of Search ..... 229/303, 304, 305, 306

[56] References Cited

U.S. PATENT DOCUMENTS

| | | | |
|---|---|---|---|
| 1,762,084 | 6/1930 | Snyder | 229/306 X |
| 1,874,796 | 8/1932 | Palm | 229/306 X |
| 2,158,528 | 5/1939 | Sawdon | 229/305 X |
| 2,340,700 | 2/1944 | Sawdon | 229/306 |
| 3,955,750 | 5/1976 | Huffman . | |
| 3,981,435 | 9/1976 | Johnsen . | |
| 4,148,430 | 4/1979 | Drake . | |
| 4,239,114 | 12/1980 | Denay . | |
| 4,669,652 | 6/1987 | Seguin | 229/306 X |
| 4,715,531 | 12/1987 | Stewart et al. . | |
| 4,852,795 | 8/1989 | Volk et al. . | |
| 4,927,072 | 5/1990 | Jenkins et al. . | |
| 4,981,251 | 1/1991 | Jenkins | 229/304 X |
| 5,174,494 | 12/1992 | Ashby | 229/305 |

FOREIGN PATENT DOCUMENTS

| | | | |
|---|---|---|---|
| 0128738 | 12/1984 | European Pat. Off. | 229/303 |
| 0393896 | 11/1965 | Switzerland | 229/303 |

*Primary Examiner*—Allan N. Shoap
*Assistant Examiner*—Jes F. Pascua
*Attorney, Agent, or Firm*—Nixon & Vanderhye

[57] ABSTRACT

A mailer type business form and intermediate are constructed from a single quadrate sheet of paper having first through fourth edges and first and second fold lines, which cooperate to divide the sheet into four panels. The first panel has a cutout positioned to overlie an outgoing address printed on the second panel, when the sheet is folded about the first fold line. Reply address indicia, including bar coding, is printed on the second face of the second panel. Two strips of transfer tape on the first face of the fourth panel cooperate to allow the second and fourth panels to be formed into a return envelope by the recipient. A return envelope flap with rewettable adhesive strip is formed from a second panel. Strips of heat or pressure activated adhesive are disposed adjacent the edges and/or first fold line of various panels in order to seal the sheet into a mailer when folded about the fold lines, and perforation lines are disposed adjacent each of the adhesive strips.

20 Claims, 3 Drawing Sheets

FIG. 3
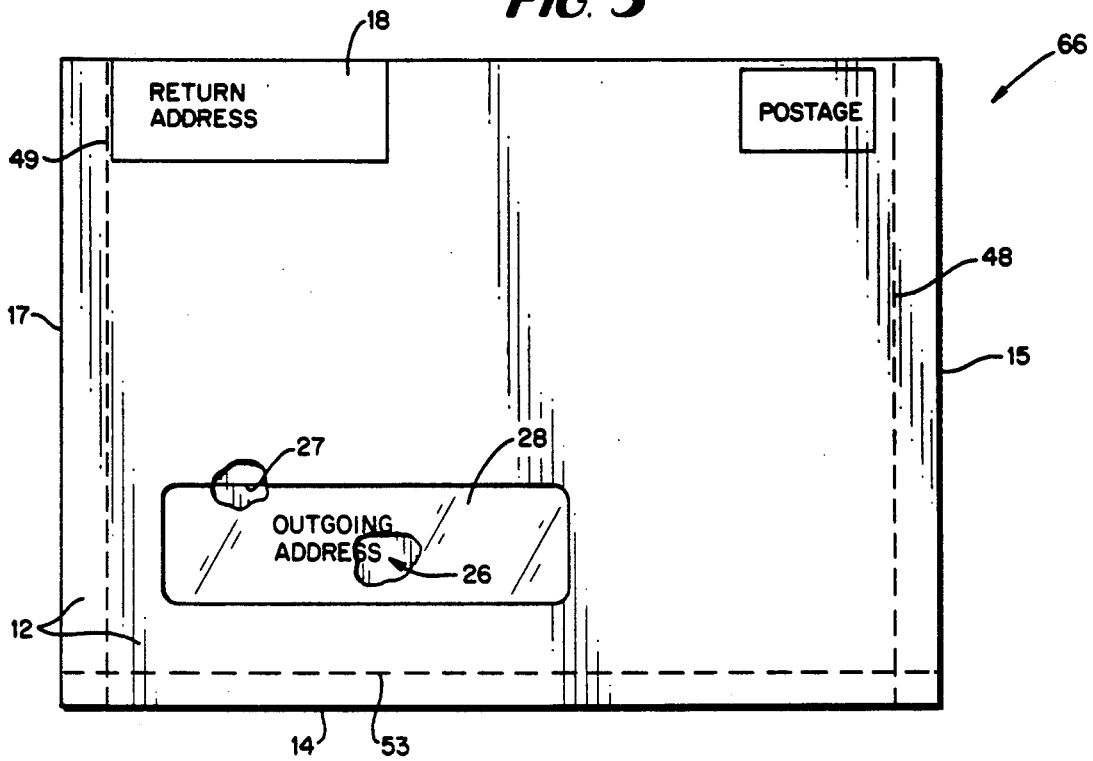
FIG. 4
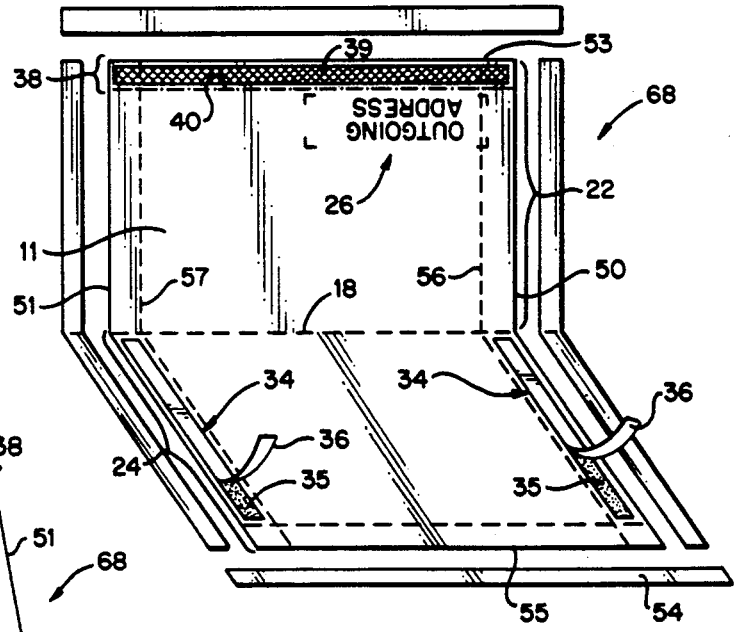
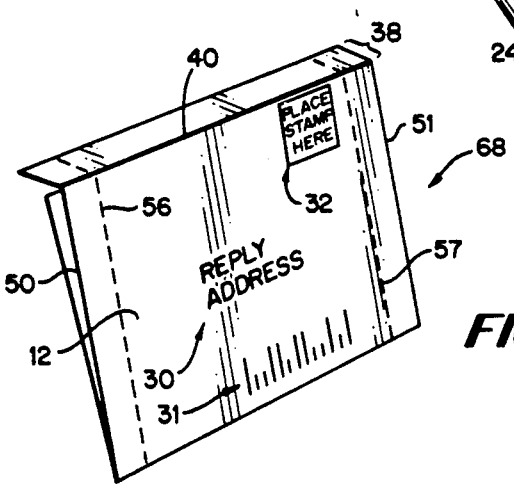
FIG. 5

BIFOLD MAILER WITH RETURN ENVELOPE

BACKGROUND AND SUMMARY OF THE INVENTION

Mailer type business forms are an increasingly common types of business forms. In the construction of any mailer type business form it is desirable to be able to transmit as much information as possible to the ultimate recipient, utilizing as little material (particularly paper) as possible, allowing ready recyclability of the paper that is utilized, and ensuring that all postal service regulations are complied with (particularly that the outgoing address is the only address visible on the outgoing mailer, and the reply address is the only address visible on the return envelope).

According to the present invention a mailer type business form, and an intermediate for producing this business form, are provided which have the desirable attributes set forth above. The mailer is constructed from a single sheet of paper, and has maximum interior area on which indicia can be imprinted, including the interior of what will ultimately become the return envelope. Also, perforations are provided adjacent each of the glue or adhesive strips associated with the mailer panels, including the return envelope, so that the paper portions of each of the panels may be readily detached from the adhesive (the strips of paper having adhesive not being recyclable) and recycled. Further, the return envelope can be constructed in a very simple manner, and the outgoing and reply addresses are printed so that they are readily visible on the outgoing and return envelope configurations, respectively, and are the only addresses visible on the outgoing mailer and return envelope respectively, the reply address being hidden within the outgoing mailer, and the outgoing address being hidden within the interior of the return envelope.

According to one aspect of the present invention a mailer type business form intermediate is provided. The intermediate comprises the following components: A quadrate sheet having first and second parallel edges, and third and fourth parallel edges perpendicular to the first and second edges, and first and second faces. A first fold line substantially bisecting the first and second edges and extending perpendicular thereto, and a second fold line substantially bisecting the third and fourth edges and extending substantially perpendicular thereto. The fold lines defining the sheet into first, second, third and fourth panels, the first and second panels adjacent each other along the second edge, the third and fourth panels adjacent each other along the first edge, and the fourth panel diagonal from the first panel. Outgoing address indicia printed on the second panel first face. Means defining a cutout in the first panel of a size and shape, and so positioned, that if the sheet is folded about the first fold line the cutout overlies the outgoing address indicia, which is visible through the cutout. Reply address indicia printed on the second face of either the second or fourth panel. First and second spaced strips of transfer tape provided on the first face of one or both of said second and fourth panels, adjacent and substantially parallel to the first fold line and the fourth edge. Means defining a return envelope flap in one of the second and fourth panels extending substantially perpendicular to the strips of transfer tape and at least spanning substantially the entire spacing between them, and including first adhesive means disposed on the first face of the flap. Second adhesive means disposed on the first face of at lest some of the panels, adjacent the edges thereof, for holding the first and third panel first faces in contact, respectively, with the second and fourth panel first faces, if the sheet is folded about the first fold line. And, third adhesive means disposed on one or both of the second and fourth panels second face adjacent at least one of the edges and the first fold line for holding the second and fourth panel second faces in contact with each other if the sheet is folded about the second fold line.

First and second sets of perforation lines (or other lines of weakness) are provided adjacent each of the adhesive means described above, to allow ready opening of the outgoing mailer, and return envelope, and to increase recyclability of the basic paper forming the mailer intermediate. Indicia is printed on the first face of all four panels, allowing much data to be transmitted to the recipient of the mailer. The second and third adhesive strips preferably comprise heat seal adhesive, although they also may comprise pressure seal adhesive or cohesive. The first adhesive means preferably comprises rewettable adhesive. The reply address indicia preferably also includes bar coding, and a transparent covering may be provided over the cutout.

The mailer according to the present invention is of the same construction as the intermediate, only is formed when the intermediate is folded first about its first fold line, and then about its second fold line, and passed through a heat sealer or the like to seal the second and third adhesive means to form the mailer. The return envelope is constructed by the outgoing addressee once he or she tears along the perforation lines to open up the mailer, and removes the covering for the adhesive of the transfer tape and folds the second and fourth panels about the second fold line to form the return envelope.

It is the primary object of the present invention to provide an advantageous mailer type business form, and intermediate for construction thereof, made from a single sheet of paper, having maximum data that can be transmitted to the addressee, and in which the outgoing address is the only address visible on the outgoing mailer, and the reply address is the only address visible on the return envelope. This and other objects of the invention will become clear from an inspection of the detailed description of the invention and from the appended claims.

BRIEF DESCRIPTION OF THE DRAWINGS

FIG. 3 is a top plan view of an exemplary mailer type business form according to the present invention, with the outgoing address visible;

FIG. 4 is a perspective view showing detachment of various portions of the mailer of FIG. 3 during the construction of a return envelope; and FIG. 5 is a front perspective view of the return envelope made from the mailer of FIG. 3.

DETAILED DESCRIPTION OF THE DRAWINGS

Figure 1:
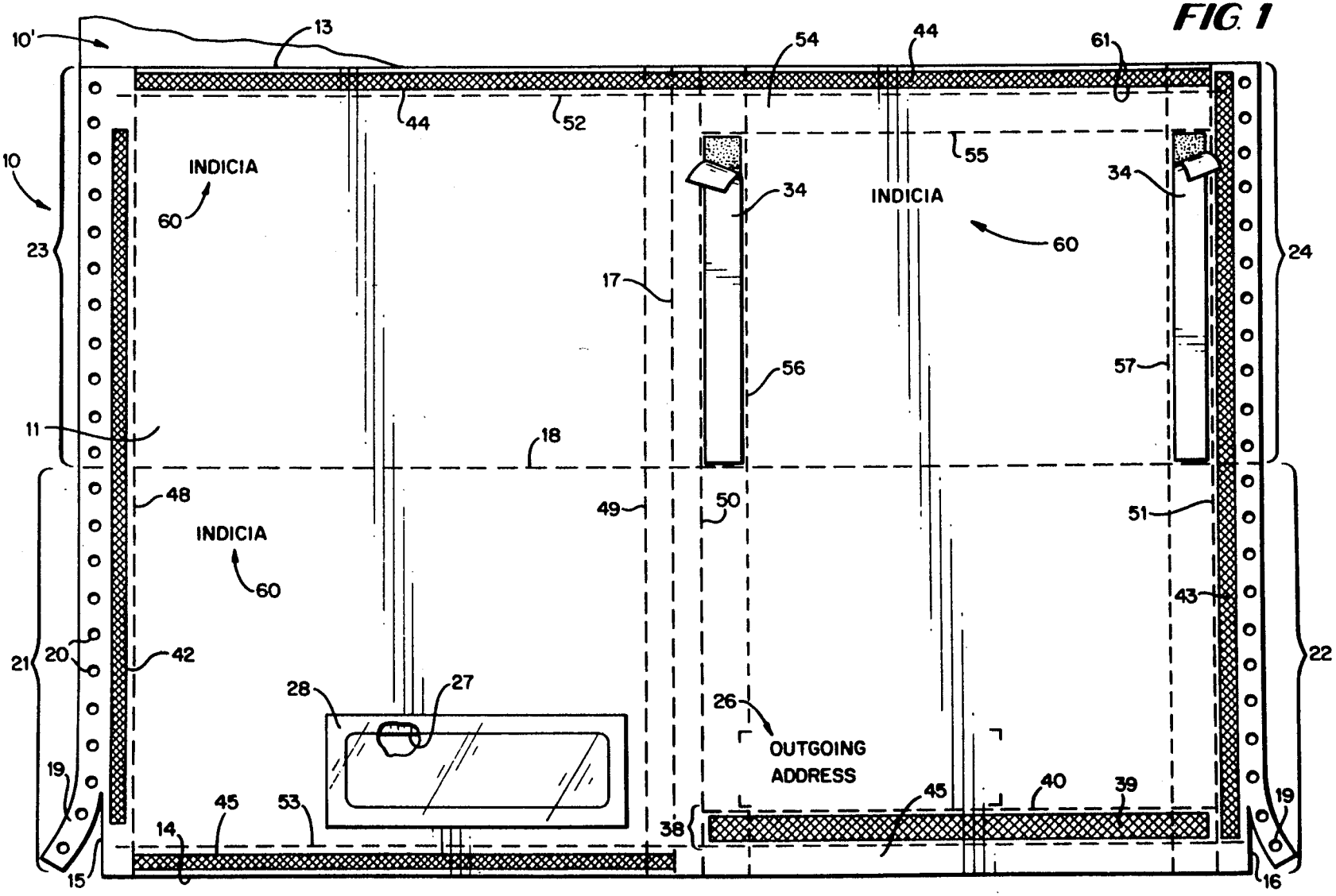
FIG. 1 is a top plan view of a mailer type business form intermediate according to the present invention.
Figure 2:
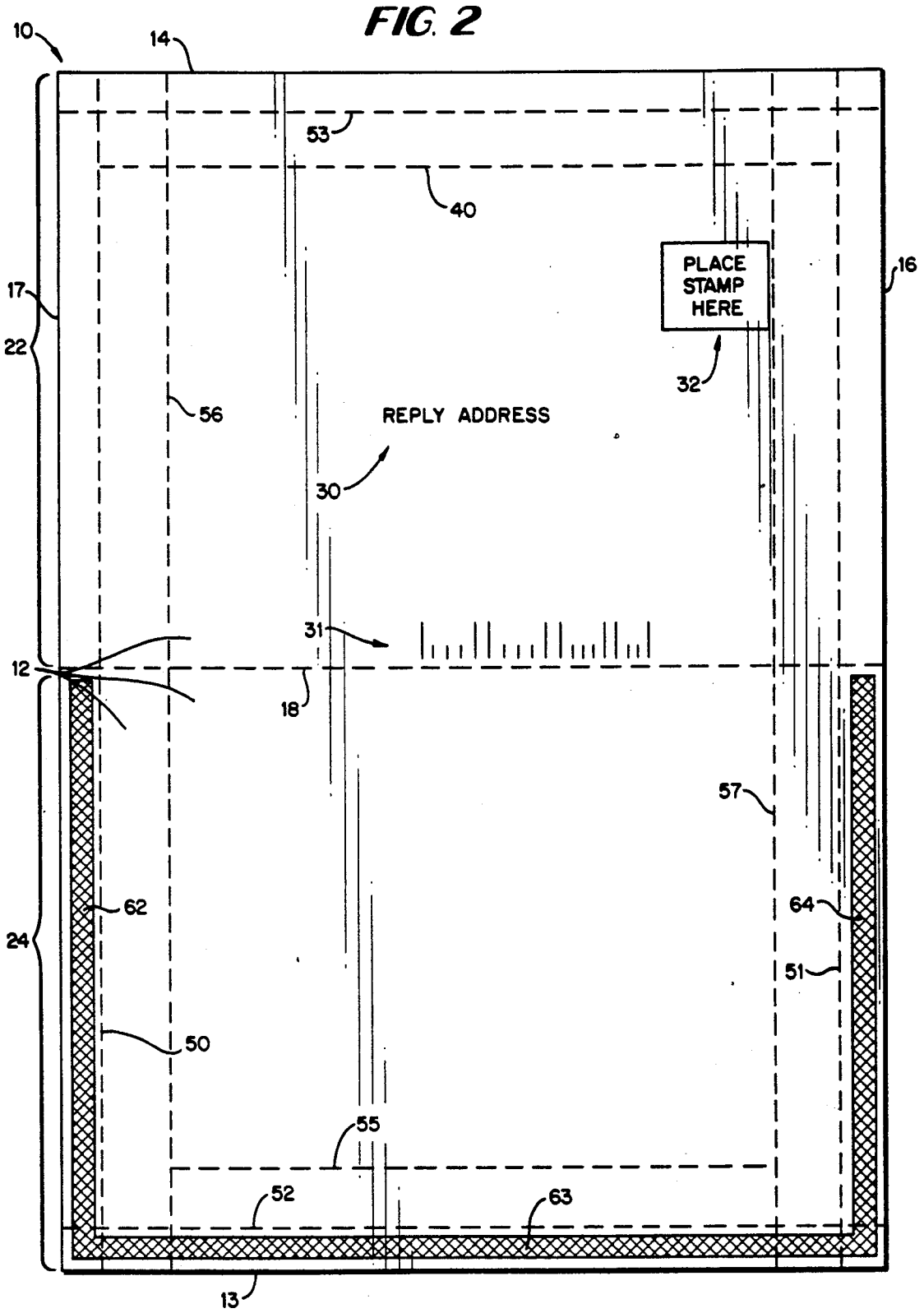
FIG. 2 is a top plan view of the intermediate of FIG. 1 after it has been folded about a first fold line thereof.

A mailer type business form intermediate according to the present invention is shown generally by reference numeral 10 in FIG. 1, and folded about a first fold line in FIG. 2. The intermediate 10 is made from a quadrate single sheet (preferably paper) and has a first face 11 (FIG. 1), and a second face 12 (FIGS. 2 and 3). The sheet forming the intermediate 10 has first and second parallel edges 13, 14, and third and fourth parallel edges 15, 16, also perpendicular to the first and second edges 13, 14. A first fold line 17 substantially bisects the first and second edges 13, 14 and extends perpendicular thereto, and a second fold line 18 substantially bisects the third and fourth edges 15, 16 and extends substantially perpendicular thereto (and to the first fold line 17). As seen in FIG. 1, when the mailer intermediate is first constructed it is typically in continuous format (see intermediate 10'), with like intermediates connected along edges 13, 14 thereof (which edges 13, 14 are perf lines). In order to facilitate feeding of the intermediate 10 for printing and other operations, marginal strips 19 (see FIG. 1), having tractor drive openings 20 therein, are provided along the third and fourth edges 15, 16. However the marginal portions 19 are slit off utilizing conventional slitting equipment before the final mailer is formed.

The fold lines 17, 18 define the sheet 10 into first (21), second (22), third (23), and fourth (24) panels or quadrants, the panels 21 through 24 having the relative relationships between the edges 13 through 16 and fold lines 17, 18 illustrated in FIG. 1.

According to the present invention outgoing address indicia 26 (see FIGS. 1 and 3) is provided printed on the second panel 22 first face 11. In the first panel 21 is means forming a cutout 27, the cutout 27 preferably being covered (at the face 11 of the intermediate 10) by a glassene or like transparent material patch 28. The cutout 27 is dimensioned and positioned with respect to the outgoing address 26 so that when the intermediate 10 is folded about the first fold line 17, the cutout 27 overlies the outgoing address 26, and the outgoing address 26 is clearly visible therethrough (see FIG. 3).

The reply address is preprinted on the mailer according to the present invention, but is printed at a position where it is not at all visible in the outgoing configuration of the mailer. This is preferably provided by printing the reply address 30 (see FIGS. 2 and 5) on the second face 12 of either the second 22 or fourth panel 24 (preferably on the second panel 22 as illustrated in FIG. 2). The reply address also preferably includes preprinted bar coding 31, and there also can be a preprinted place for postage to be inserted 32.

The intermediate 10 according to the present invention also includes first and second spaced strips of transfer tape 34 (FIGS. 1 and 4). As seen in FIG. 4, adhesive 35 from the transfer tape remains on the paper defining the first face 11 of the intermediate 10 once the transfer tape backing 36 is pulled away. The transfer tape strips 34 facilitate construction of a return envelope, as will be hereinafter described. The transfer tape 34 may be provided on one or both of the panels 22, 24, and preferably two strips 34 are provided on the fourth panel 24 parallel to and adjacent the first fold line 17 and fourth edge 16.

The intermediate 10 further comprises means defining a return envelope flap 38 (see FIGS. 1, 4, and 5). The flap 38 is formed from one of the second or fourth panels 22, 24, preferably in the second panel 22 adjacent the outgoing address 26 as illustrated in FIG. 1. Positioned in this way, when the return envelope is formed the outgoing address 26 is hidden within the return envelope. The flap 38 has adhesive disposed on the face 11, preferably rewettable glue in the configuration of a strip 39, and preferably a fold line or line of weakness 40 is disposed parallel to the strip 39 between it and the outgoing address 26.

The intermediate 10 also comprises second adhesive means disposed on the first face 11 of at least some of the panels 21 through 24, adjacent the edges thereof, for holding the first and third panel 21, 23 first faces 11 in contact, respectively, with the second and fourth panel 22, 24 first faces 11, when the sheet 10 is folded about the first fold line 17. A second adhesive means may, for example, take the form of strips of adhesive 42 through 45 (see FIG. 1) disposed adjacent the edges 13 through 16. The strips 42 through 45, or like patterns of adhesive, preferably are permanent type adhesive that is activated to effect sealing, such as heat activated adhesive, or pressure activated adhesive or cohesive.

The intermediate 10 also comprises third adhesive means disposed on one or both of the second and fourth panels 22, 24 second faces 12 adjacent at least one of said edges 13, 14, 16 and said fold line 17. In the embodiment illustrated in FIG. 2, adhesive strips 62, 63, 64 are provided adjacent the fold line 17, first edge 13, and fourth edge 16, respectively. The adhesive patterns 62 through 64 preferably are of the same type of adhesive as the patterns 42 through 45. The adhesive patterns 62 through 64 hold the second faces 12 of the second and fourth panels 22, 24 together when the intermediate 10 is folded about the second fold line 18.

In order to facilitate opening up of the mailer, various lines of weakness or perforations are provided adjacent the various glue strips 42 through 45, and 62 through 64. For example perforations 48, 49, 50, and 51 are provided adjacent glue strip 42, straddling first fold line 17, and adjacent glue strip 43, respectively (the perforation line 51 also being adjacent glue strip 64 since it is on the opposite face of the sheet 10 as the glue strip 43). Similarly, perforations 52, 53 are provided adjacent the glue strips 44 (and 63) and 45, respectively. All of the perforations 48 through 53 allow the mailer 66 (see FIG. 3) to be readily opened by tearing along these perf lines, which allows the inside faces 11 of each of the panels 21, 24 to be viewed.

Additional perforation lines 55 through 57 also may be provided. The perforation line 55 forms, with the perforation line 52, a removable stub 54 so that the flap 38 will overlap the remaining portion of the panel 24 when the return envelope 68 (see FIGS. 4 and 5) is being constructed. The perforation lines 56, 57 are for facilitating opening of the return envelope 68 once it has been mailed back to the reply addressee.

One of the advantages of the mailer 66 according to the present invention is that there is much interior space within the mailer for data to be provided to the outgoing addressee. As illustrated by the indicia 60 in FIG. 1, all of the faces 11 of the panels 21 through 24 (except where the outgoing address 26 and the cutout 27 are provided) that are within the perforation lines, can be printed with indicia during the construction of the intermediate 10. Also indicia, such as indicia 61 (FIG. 1) which provides instructions to the recipient of the mailer 66, also can be provided.

The mailer 66 of FIG. 3 is constructed from the intermediate 10 by first detaching the intermediate 10 from any other like intermediates (e.g. 10') in continuous format, then folding about the first fold line 17 so that the faces 11 of the panels 21, 22 and 23, 24, respectively, come into contact with each other (the position illustrated in FIG. 2). Then the intermediate is folded about the fold line 18 so that the second faces 12 of the panels 22, 24 come in contact with each other, thereby hiding the reply address 30 within the outgoing mailer 66, but allowing the outgoing address 26 to be readily viewed through the cutout 27.

Once the outgoing addressee receives the mailer 66, he or she tears along the perforations 48 through 53 to open up the individual panels 21 through 24 to expose the indicia 60. After the indicia 60 have been read and it is desired to construct the return envelope 68, first the stub 54 is removed by detachment along the perforation line 55, then the backing strips 36 for the pieces of transfer tape 34 are removed (see FIG. 4), and then the panels 22, 24 are folded about the second fold line 18 so as to seal the first faces 11 of the panels 22, 24 together. The flap 38 extends above the "top" edge 55 of the panel 24. With the return envelope 68 (see FIG. 5 in particular) now constructed, the user inserts into the return envelope 68 a check, form, or any other material desired to be returned, then wets the rewettable adhesive 39, bends the flap 38 about the line 40, and brings the adhesive 39 into contact with the second face 12 of the panel 24 thereby forming a closed return envelope 68 having the reply address indicia 30, 31 (see FIG. 5) clearly visible thereon. When the return envelope 68 is received back by the original sender, it is readily opened by detachment along the perforation lines 56, 57.

It will thus be seen that according to the present invention an advantageous mailer type business form, and intermediate for constructing such a form, have been provided. While the invention has been herein shown and described in what is presently conceived to be the most practical and preferred embodiments thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A mailer type business form intermediate, comprising:

a quadrate sheet having first and second parallel edges, and third and fourth parallel edges perpendicular to said first and second edges, and first and second faces;

a first fold line substantially bisecting said first and second edges and extending perpendicular thereto, and a second fold line substantially bisecting said third and fourth edges and extending substantially perpendicular thereto;

said fold lines defining said sheet into first, second, third and fourth panels, said first and second panels adjacent each other along said second edge, said third and fourth panels adjacent each other along said first edge, and said fourth panel diagonal from said first panel;

outgoing address indicia printed on said second panel first face;

means defining a cutout in said first panel of a size and shape, and so positioned, that when said sheet is folded about said first fold line said cutout overlies said outgoing address indicia, which is visible through said cutout;

reply address indicia printed on said second face of at least one of said second and fourth panel;

first and second spaced strips of transfer tape provided on said first face of one or both of said second and fourth panels, adjacent and substantially parallel to said first fold line and said fourth edge;

means defining a return envelope flap in one of said second and fourth panels extending substantially perpendicular to said strips of transfer tape and at least spanning substantially the entire spacing between them, and including first adhesive means disposed on said first face of said flap;

second adhesive means disposed on said first face of said panels, adjacent said edges thereof, for holding said first and third panel first faces in contact, respectively, with said second and fourth panel first faces, when said sheet is folded about said first fold line; and third adhesive means disposed on at least one of said second and fourth panels second face adjacent at least one of said edges and said first fold line for holding said second and fourth panel second faces in contact with each other when said sheet is folded about said second fold line.

2. An intermediate as recited in claim 1 further comprising a first set of perforations extending adjacent and parallel to said second and third adhesive means, and said first fold line.

3. An intermediate as recited in claim 2 further comprising a second set of perforations extending parallel to and adjacent said strips of transfer tape, on the opposite side of said strips of transfer tape from said first fold line and said fourth edge.

4. An intermediate as recited in claim 1 wherein said transfer tape is disposed on said fourth panel only.

5. An intermediate as recited in claim 4 wherein said return envelope flap is formed from said second panel.

6. An intermediate as recited in claim 5 further comprising means defining a removable stub on said fourth panel parallel to said flap and spaced the same distance from said second fold line as is said flap.

7. An intermediate as recited in claim 1 further comprising indicia printed on said first face of each of said first, second, third, and fourth panels.

8. An intermediate as recited in claim 1 wherein said second and third adhesive means comprise strips of heat activated adhesive.

9. An intermediate as recited in claim 8 wherein said heat activated adhesive strips of said second adhesive means are disposed along substantially the entire length of and adjacent both said third and fourth edges, and adjacent and extending substantially the length of said first and second edges; and wherein said third adhesive strips are disposed on said second face of one of said second and fourth panels, adjacent and parallel to said first fold line, said fourth edge, and either said first or second edge.

10. An intermediate as recited in claim 1 wherein said reply address indicia includes bar coding, and wherein said first adhesive means comprises rewettable glue, and wherein said cutout in said first panel is covered by a transparent covering disposed in association with said first face.

11. A mailer type business form comprising:

a quadrate sheet having first and second parallel edges, and third and fourth parallel edges perpendicular to said first and second edges, and first and second faces;

a first fold line substantially bisecting said first and second edges and extending perpendicular thereto, and a second fold line substantially bisecting said third and fourth edges and extending substantially perpendicular thereto;

said fold lines defining said sheet into first, second, third and fourth panels, said first and second panels adjacent each other along said second edge, said third and fourth panels adjacent each other along said first edge, and said fourth panel diagonal from said first panel;

said sheet folded about said first fold line, and second fold line;

outgoing address indicia printed on said second panel first face;

means defining a cutout in said first panel of a size and shape, and so positioned, so that said cutout overlies said outgoing address indicia, which is visible through said cutout;

reply address indicia printed on said second face of either said second or fourth panel;

first and second spaced, strips of transfer tape provided on said first face of at least one of said second and fourth panels, adjacent and substantially parallel to said first fold line and said fourth edge;

means defining a return envelope flap in one of said second and fourth panels extending substantially perpendicular to said strips of transfer tape and at least spanning substantially the entire spacing between them, and including first adhesive means disposed on said first face of said flap;

second adhesive means disposed on said first face of said panels, adjacent said edges thereof, for holding said first and third panels first faces in contact, respectively, with said second and fourth panel first faces; and third adhesive means disposed on at least one of said second and fourth panels second face adjacent at least one said edges and said first fold line for holding said second and fourth panel second faces in contact with each other.

12. A mailer as recited in claim 11 further comprising a first set of perforations extending adjacent and parallel to said second and third adhesive means, and said first fold line.

13. A mailer as recited in claim 12 further comprising a second set of perforations extending parallel to and adjacent said strips of transfer tape, on the opposite side of said strips of transfer tape from said first fold line and said fourth edge.

14. A mailer as recited in claim 11 wherein said transfer tape is disposed on said fourth panel only.

15. A mailer as recited in claim 14 wherein said return envelope flap is formed from said second panel.

16. A mailer as recited in claim 15 further comprising means defining a removable stub on said fourth panel parallel to said flap and spaced the same distance from said second fold line as is said flap.

17. A mailer as recited in claim 11 further comprising indicia printed on said first face of each of said first, second, third, and fourth panels.

18. A mailer as recited in claim 11 wherein said second and third adhesive means comprise strips of heat activated adhesive.

19. A mailer as recited in claim 18 wherein said heat activated adhesive strips of said second adhesive means are disposed along substantially the entire length of and adjacent both said third and fourth edges, and adjacent and extending substantially the length of said first and second edges; and wherein said third adhesive strips are disposed on said second face of one of said second and fourth panels, adjacent and parallel to said fold line, said fourth edge, and either said first or second edge.

20. A mailer as recited in claim 11 wherein said reply address indicia includes bar coding, and wherein said first adhesive means comprises rewettable glue, and wherein said cutout in said first panel is covered by a transparent covering disposed in association with said first face.

* * * * *